US005810200A

United States Patent [19]

Trokhan

[11] Patent Number: 5,810,200

[45] Date of Patent: Sep. 22, 1998

[54] POP-UP TISSUE PACKAGE

[75] Inventor: Paul Dennis Trokhan, Hamilton, Ohio

[73] Assignee: The Procter & Gamble Company, Cincinnati, Ohio

[21] Appl. No.: 695,041

[22] Filed: Aug. 9, 1996

[51] Int. Cl.[6] ..... A47K 10/24

[52] U.S. Cl. ..... 221/55; 225/106

[58] Field of Search ..... 221/50, 55, 45, 221/33, 36, 63, 282, 210, 259; 225/106

[56] References Cited

U.S. PATENT DOCUMENTS

| | | | |
|---|---|---|---|
| 2,890,791 | 7/1959 | Wenzel | 206/57 |
| 3,021,002 | 2/1962 | Guyer | 206/57 |
| 3,576,243 | 4/1971 | Trunnick | 221/63 |
| 3,795,355 | 3/1974 | Gerstein | 225/106 |
| 3,881,632 | 5/1975 | Early et al. | 221/50 |
| 4,458,810 | 7/1984 | Mahoney | 206/210 |
| 4,574,952 | 3/1986 | Masui | 206/494 |
| 4,623,074 | 11/1986 | Dearwester | 221/48 |
| 5,219,424 | 6/1993 | Simhaee | 225/47 |
| 5,480,084 | 1/1996 | Daniels | 225/106 |
| 5,516,001 | 5/1996 | Muckenfuhs et al. | 221/63 |
| 5,520,308 | 5/1996 | Berg et al. | 221/50 |
| 5,573,168 | 11/1996 | Kannankeril et al. | 225/106 |

*Primary Examiner*—Kenneth Noland
*Attorney, Agent, or Firm*—Jacobus C. Rasser; E. Kelly Linman; Larry L. Huston

[57] ABSTRACT

A tissue package comprising tissues and a dispensing package in combination. The dispensing package has a dispensing opening through which the tissues are dispensed. The dispensing package further has an engaging tab which separates one of the tissues as it is dispensed, thereby separating the tissue from succeeding tissues.

17 Claims, 2 Drawing Sheets

POP-UP TISSUE PACKAGE

FIELD OF THE INVENTION

This invention relates to a dispensing package for tissues. More particularly, this invention relates to a package for sequential dispensing of tissues which pop-up beyond the walls of the tissue package, and typically pop-up above the top wall of the dispensing package, when the preceding tissue is removed.

BACKGROUND OF THE INVENTION

Tissues are well known in the art. Tissues, such as facial tissues, are commonly used for blowing one's nose, cleaning tasks, etc. Tissues can also be used as paper towels for wiping, clean-up tasks, etc. Tissues, and their packaging, must be inexpensive and disposable to be widely consumer accepted. Tissues may be supplied dry, with lotion, or moistened. Such tissues are generally rectangular in shape and supplied in discrete sheets. Tissues are typically supplied in a generally parallelepipedly shaped box or dispensing package. The dispensing package has a dispensing opening, typically at the top, through which the individual sheets are removed by the user.

Early tissue dispensing packages were of the "reach-in" type. The user had to insert his or her fingers through the dispensing opening, grasp a tissue, and pull it out through the dispensing opening. Examples of reach-in dispensers and improvements thereto can be found in U.S. Pat. No. 3,021,002, issued Feb. 13, 1962 to Guyer; commonly assigned U.S. Pat. No. 3,576,243, issued Apr. 27, 1971 to Trunnick; and U.S. Pat. No. 4,458,810 issued Jul. 10, 1984 to Mahoney.

Over time, the desire for increased convenience led to sequential or pop-up dispensers. In a "pop-up" dispenser, a tissue usually extends through the dispensing opening to an elevation above that of the dispensing package. The user simply grasps the exposed portion of the the necessity of inserting fingers through the dispensing opening. In pop-up dispensing, each tissue has a leading portion which is first to pass through the dispensing opening, and a trailing portion which later passes through the dispensing opening. Typically, the trailing portion of a tissue to be dispensed overlaps the leading portion of the next tissue to be dispensed. The overlap is measured generally parallel to the direction of withdrawal of the tissues through the dispensing opening. The overlap is usually, but not necessarily, the same for each tissue and constant throughout the width of each tissue. As the first tissue is withdrawn by the user, the leading portion of the next tissue is pulled through the dispensing opening, for later dispensing.

Typically, the sequential withdrawal of the succeeding tissue through the dispensing opening occurs due to interfolding of adjacent tissues. An example of an interfolding arrangement is found in commonly assigned U.S. Pat. No. 3,881,632, issued May 6, 1975 to Early et al., the disclosure of which is incorporated herein by reference.

Attempts to improve pop-up dispensing packages also include attachment of the tissues to the removable top of the box, so that the first tissue is pulled through the dispensing opening when the box is opened. Still another attempt provides a lapping flap which allegedly holds partially dispensed sheets from falling back into the package. Examples of such attempts in the art include U.S. Pat. No. 2,890,791, issued Jun. 16, 1959 to Wenzel; and U.S. Pat. No. 4,574,952, issued Mar. 11, 1986 to Masui. A commercially successful improvement in the art is the dual mode dispensing package which allows for both pop-up and reach-in dispensing, as found in commonly assigned U.S. Pat. No. 4,623,074, issued Nov. 18, 1986 to Dearwester, the disclosure of which is incorporated herein by reference. Yet another teaching which provides for sequential dispensing from a reach-in and pop-up mode is found in commonly assigned U.S. Pat. No. 5,516,001, issued May 14, 1996 to Muckenfuhs et al., the disclosure of which is incorporated herein by reference.

However, there has been a suggestion in the art to no longer use interfolding arrangements. Apparatuses for interfolding are both complex and expensive. The purchase of such an apparatus represents a capital outlay which is ultimately passed on to the consumer.

A teaching to avoid interfolding and yet provide for pop-up dispensing is found in commonly assigned U.S. Pat. No. 5,520,308, issued May 28, 1996 to Berg et al., the disclosure of which is incorporated herein by reference.

There remains a need in the art to improve pop-up dispensing, particularly for non-interleaved tissues. There further remains a need in the art for a package which allows for dispensing of one, two, or more sheets at a time, as desired by the user. It is an object of the present invention to meet such needs in the art, as well as provide a dispensing package which is easily adjusted to accommodate the different degrees of separation forces necessary to separate adjacent tissues joined by various attachment means.

SUMMARY OF THE INVENTION

The invention comprises a tissue package comprising a plurality of tissues and a dispensing package in combination. The tissues are separably joined together in succession for dispensing from the dispensing package. The dispensing package houses the tissues and has an opening through which the tissues are dispensed. The dispensing package further has an engaging tab extending from a proximal end to a distal end. The engaging tab intercepts one of the tissues as it is dispensed from the dispensing package. When the engaging tab intercepts the tissue, it is separated from the succeeding tissues which remain in the dispensing package.

The engaging tab exerts a frictional force against the tissues, causing separation to occur when the tissue is intercepted by the engaging tab. The engaging tab may be biased towards the tissues. Such biasing may provide for an increase in the frictional force as the tissue is dispensed.

DETAILED DESCRIPTION OF THE INVENTION

Figure 1:
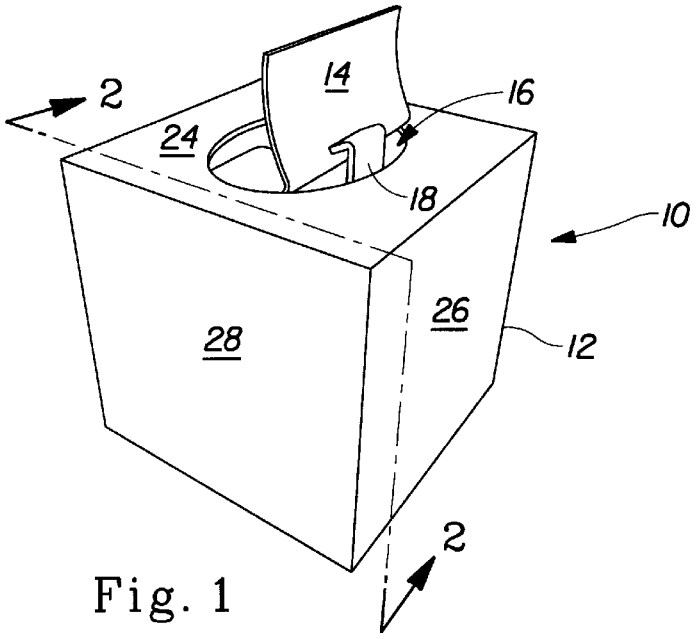
FIG. 1 is a perspective view of a dispensing package according to the present invention.

Referring to FIG. 1, the tissue package 10 according to the present invention comprises a dispensing package 12 and tissues 14 in combination. The dispensing package 12 may have defined walls, and is preferably generally parallelepipedly shaped. The dispensing package 12 further has a dispensing opening 16 therethrough. The tissues 14 are dispensable through the dispensing opening 16. The dispensing package 12 further has an engaging tab 18 for intercepting one of the tissues 14 as it is dispensed from the package. The engaging tab 18 separates one tissue 14 from succeeding tissues 14.

Examining the dispensing package 12 in more detail, it may have discrete walls. The walls preferably define a top 24, a bottom, front and back sides 26 and left and right sides 28. Preferably the dispensing opening 16 intercepts the top wall 24, and may intercept one of the other walls 26, 28 of the dispensing package 12, so that the tissues 14 are dispensed in a pop-up manner. A suitable dispensing package 12 may be generally made in accordance with the teachings of the aforementioned commonly assigned U.S. Pat. No. 4,623,074 previously incorporated by reference.

The tissue package 10 according to the present invention can either be disposable or refillable. By "disposable" it is meant the dispensing package 12 is intended to be discarded after the plurality of tissues 14 supplied therewith is depleted. Such a dispensing package 12 is not intended to be restocked with tissues 14. Likewise, each tissue 14 is discarded after use, and is not laundered or otherwise restored. By "refillable" it is meant the dispensing package 12 is or may be restocked with tissues 14 after the supply is depleted.

Examining the tissues 14 in more detail, the tissues 14 comprise a plurality of discrete sheets or sheets which are separable. As used herein, tissues 14 are considered to be "discrete" if they are separate from other tissues 14 prior to being releasably joined to adjacent tissues 14. Tissues 14, whether or not discrete, are considered to be separable if they may be detached from one another without tearing and/or undue or unintended gross deformation of the tissue 14. It is to be recognized that a tissue 14 may be torn from an adjacent tissue 14 along a predetermined line of weakness and still be considered separable.

Separable tissues 14 may be joined together by lines of weakness, such as perforations 30, as are well known in the art. Suitable perforations 30 may be made according to commonly assigned U.S. Pat. No. 5,114,771, issued May 19, 1992 to Ogg et al. It will recognized that separably joined tissues 14 joined by perforations 30 may be core wound, as is common with bath tissue, or may be folded in any of the suitable and well known patterns. It is to be recognized that the lines of weakness or other perforations 30 will have to be modified as discussed below to be complementary to the engaging tab 18 set forth in the present invention. Alternatively, discrete tissues 14 may be joined together by interfolding, or by releasable attachment directly to an adjacent tissue 14, as discussed in the commonly assigned and incorporated U.S. Pat. No. 5,520,308 issued to Berg, Jr. et al. Releasable attachment directly to adjacent tissues 14 may be accomplished by means of adhesive, cohesive overlap, fusion bonding or by autogeneous bonding as disclosed in commonly assigned U.S. Pat. No. 4,854,984 issued Aug. 8, 1989 to Ball et al., the disclosure of which is incorporated herein by reference. Additionally, mechanical entanglement such as needle punching, steam sealing, embossing or crimping may be utilized to releasably join discrete sheets of tissue 14 to each other.

Suitable tissues 14 may be made according to commonly assigned U.S. Pat. No. 4,191,609, issued Mar. 4, 1980 to Trokhan; U.S. Pat. No. 4,637,859, issued Jan. 20, 1987 to Trokhan; and U.S. Pat. No. 5,332,118, issued Jul. 26, 1994 to Muckenfuhs, the disclosures of which are incorporated herein by reference for the purpose of showing how to make tissues 14 suitable for use with the present invention, or by any other suitable manner. It is noted the tissues 14 may either be provided wet, dry, or lotioned.

Examining the dispensing package 12 in more detail, the dispensing package 12 may have a plurality of walls 24, 26, 28, and preferably has at least one defined wall with a dispensing opening 16 therethrough. The tissues 14 are dispensable through this dispensing opening 16. The dispensing package 12 may be generally parallelepipedly shaped as shown, or, alternatively, may be made of material having a relatively amorphous shape. However, the dispensing package 12 is preferably rigid enough that the engaging tab 18 can intercept and separate adjacent tissues 14 upon dispensing through the dispensing opening 16. It is understood that the engaging tab 18 may intercept any portion of the tissue 14 which causes separation from succeeding tissues 14. The engaging tab 18 preferably intercepts the tissue 14 at the line of weakness separating adjacent tissues 14, or any other means releasably joining adjacent tissues 14, such as an overlap. The engaging tab 18 should be rigidly mounted to the dispensing package 12 so that it can apply a reaction force to the tissues 14 upon dispensing. The reaction force separates one of the tissues 14 from succeeding tissues 14.

Figure 2:
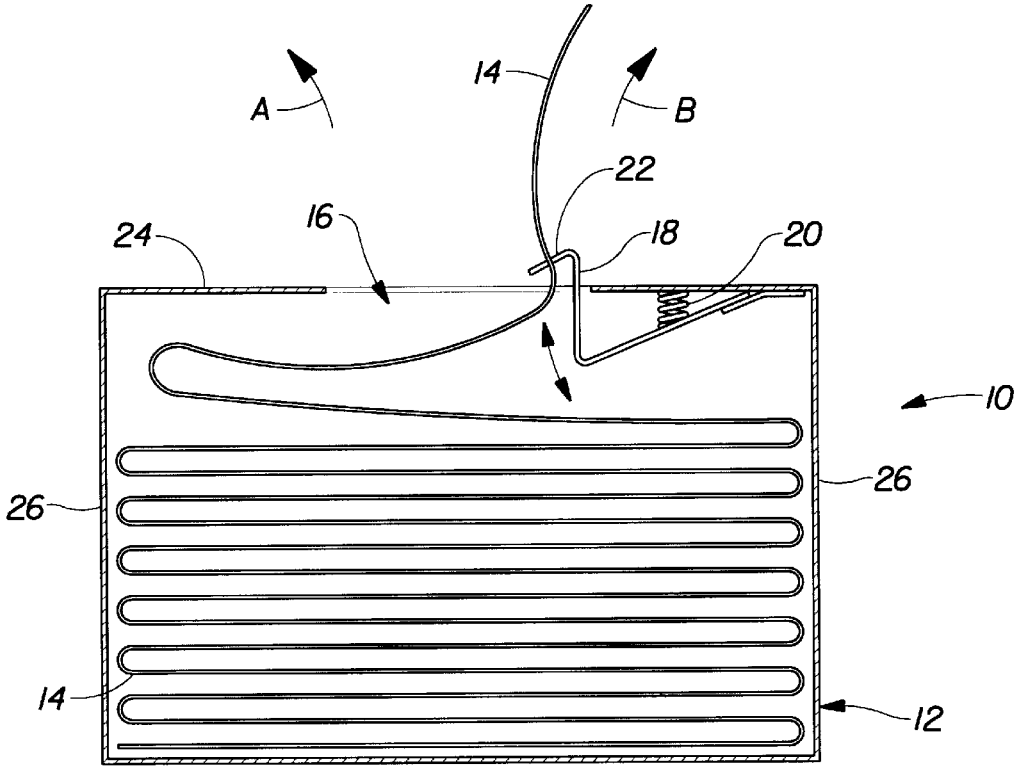
FIG. 2 is a vertical sectional view taken through line 2—2 of FIG. 1.

Referring to FIG. 2, the engaging tab 18 is mounted to the dispensing package 12 in any convenient manner and, preferably, is cantilevered from the dispensing package 12. More preferably, the walls of the dispensing package 12 have inner and outer surfaces, and the engaging tab 18 is joined to and cantilevered from one of the inner surfaces of the walls of the dispensing package 12. This arrangement provides a tissue package 10 which is relatively neat in appearance as presented to the end user. Additionally, the potential for pinch points to fingers as well as accidental disruption of the position of the engaging tab 18 is minimized.

The engaging tab 18 may be cantilevered from a proximal end, preferably spaced relatively remotely from the dispensing opening 16, and extends to a distal end. The distal end is preferably juxtaposed with the dispensing opening 16, so that it intercepts the tissues 14 upon withdrawal through the dispensing opening 16.

The engaging tab 18 may extend through the dispensing opening 16 at a position intermediate the proximal and distal ends, so that the distal end is outside of the dispensing package 12. In this manner, the engaging tab 18 may intercept the tissues 14 upon dispensing, and cause separation of one tissue 14 from an adjacent or succeeding tissue 14 by creating friction between the one tissue 14 and the adjacent or succeeding tissues 14. This arrangement provides a visual signal to the user. When the engaging tab 18 intercepts the succeeding tissue 14 (preferably at the line of weakness separating one tissue 14 from the adjacent or succeeding tissues 14) the user will recognize this has occurred because the distal end of the engaging tab 18 is outside of the tissue package 10.

The engaging tab 18 may be integral with the dispensing package 12. In this arrangement, the engaging tab 18 comprises an angular segment 22 cut out from the dispensing package 12 and folded back on itself to be cantilevered therefrom. More particularly, the engaging tab 18 may be formed from one of the rigid walls of the dispensing package 12. In this arrangement, the engaging tab 18 is not only integral with but is also hingedly connected to the dispensing package 12.

By folding the engaging tab 18 away from the rigid wall of the dispensing package 12, the engaging tab 18 may be biased towards the tissues 14. Alternatively, the engaging tab 18 may be biased towards the tissues 14 by using a separate spring. Biasing the engaging tab 18 towards the tissues 14 provides the advantage that as the tissues 14 are dispensed through the dispensing opening 16 and intercept the engaging tab 18, the friction exerted by the engaging tab 18 against the tissues 14 increases as the engaging tab 18 moves against the biasing force. The friction in this manner can be increased, as tactily discerned by the user, until the separation force is sufficient to cause separation of one tissue 14 from adjacent tissues 14. Biasing may be provided with a spring 20 which exerts a reaction force against on of the walls 26, 28 or the top 24 of the dispensing package 12.

Referring to FIG. 2, if desired, multiple tissues 14 may be dispensed from the dispensing package 12 prior to separation of one tissue 14 from the succeeding tissues 14. For example, the tissues 14 may be pulled through the dispensing package 12 in the direction of arrow A and away from the engaging tab 18. In this mode, the engaging tab 18 does not intercept the tissues 14, providing the flexibility that multiple tissues 14 may be withdrawn at the same time. When the desired number of tissues 14 have been withdrawn through the dispensing opening 16, the user may then pull in the direction of arrow B. The engaging tab 18 now intercepts the tissues 14, causing separation of the plurality of withdrawn tissues 14 from the balance of the clip.

Figure 3:
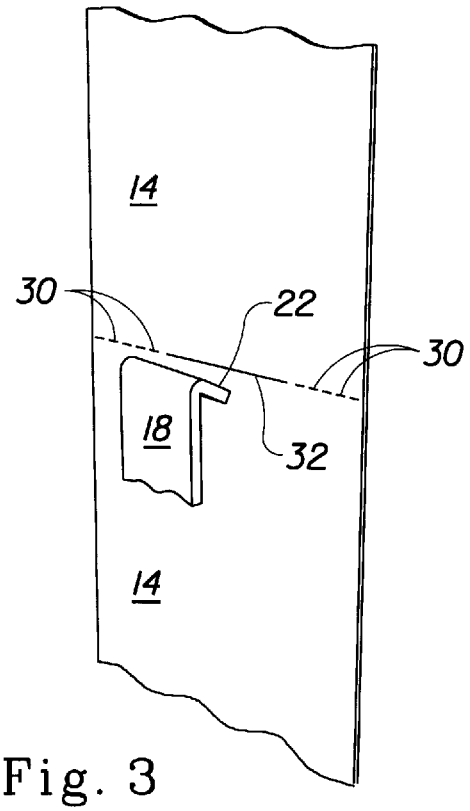
FIG. 3 is a schematic perspective view of a line of weakness having an elongate slit and an engaging tab which is complementary thereto.

Referring to FIG. 3, a particularly preferred embodiment of the present invention is shown. In this embodiment, the line of weakness separating adjacent tissues 14 comprises an elongate slit 32. The shape and position of the slit is complementary to the engaging tab 18. That is, the engaging tab 18 is sized to fit within the slit and located at a lateral (i.e., generally parallel to the line of weakness) position which allows the engaging tab 18 to mate with the elongate slit 32. In this arrangement, a tissue 14 is withdrawn successively through the dispensing opening 16 and past the engaging tab 18. The engaging tab 18 is biased towards the tissues 14. As the elongate slit 32 separating adjacent tissues 14 passes near the engaging tab 18 which is biased towards the tissues 14, the engaging tab 18 intercepts the tissue 14 at the elongate slit 32. This provides a step change in the withdrawal force and tactily signals the user that the dispensing of that tissue 14 is complete, and the tissue 14 should be torn or otherwise ripped away from the balance of the clip of tissues 14 with an adequate separation force. By providing such a step change to the user, the user is signaled that the withdrawal process is completed and the tissue 14 should be separated.

Figure 4:
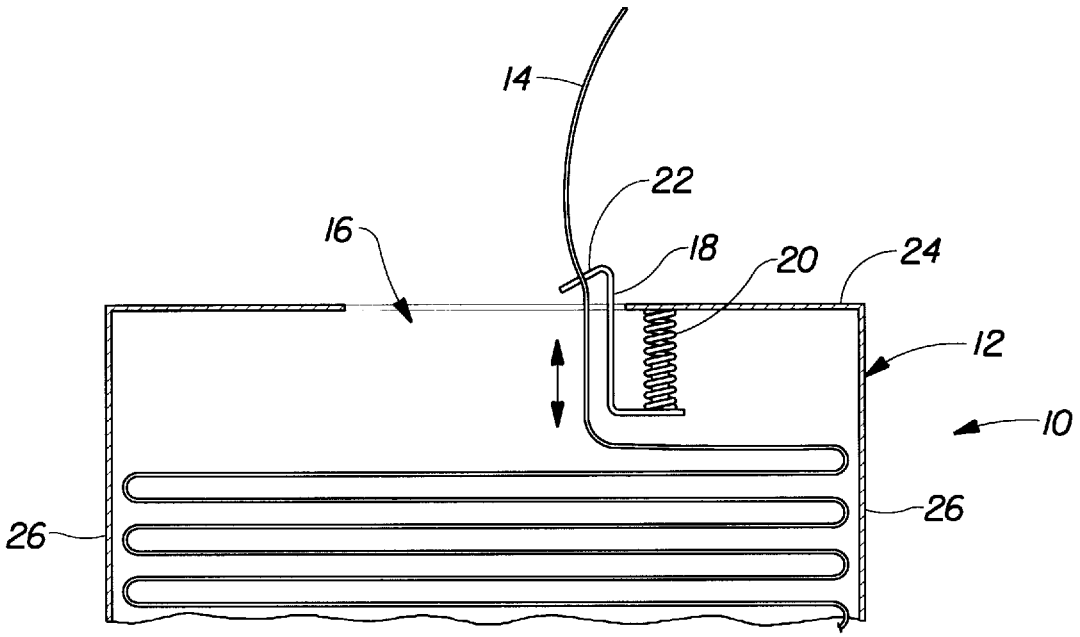
FIG. 4 is a fragmentary vertical plan view of an alternative embodiment according to the present invention having a spring and plunger in place of the articulated engaging tab of FIG. 1.

It will be apparent that many other variations are feasible and within the scope of the claimed invention. For example, a torsional spring 20 may be used to provide the biasing force of rather than the coil spring as illustrated in the figures. As illustrated in FIG. 4 a coil spring and plunger arrangement could be used rather than the hingedly connected arrangement illustrated in FIGS. 1–2.

Alternatively, multiple engaging tab 18 may be used in parallel to increase the separation force applied to the tissues 14. More particularly, a line of weakness having a plurality of elongate slits 32, and a like plurality of engaging tabs 18 may be utilized. This arrangement may be more useful for heavier basis weight sheets which require greater separation force, as is commonly used for hand towels, etc. Alternatively, the line of weakness separating adjacent tissues 14 need not be generally perpendicular to the direction of dispensing, but may be diagonal. Of course, the engaging tab 18 would have to be positioned at a like diagonal for maximum efficacy. If desired, two or more opposed engaging tabs 18 may be utilized to increase the separation force, one engaging tab 18 being disposed on each side of the tissues 14.

What is claimed is:

1. A tissue package comprising tissues and a dispensing package therefor in combination, said tissue package comprising:

a plurality of separable tissues, said tissues being separably joined together in succession for dispensing from said dispensing package; and a dispensing package for housing said tissues, said dispensing package having walls within inner surfaces and outer surfaces and a dispensing opening therethrough, said tissues being dispensable through said dispensing opening, said dispensing package having an engaging tab joined to one of said inner surfaces of said walls, said engaging tab extending from a proximal end to a distal end and intercepting one of said tissues as it is dispensed from said dispensing package, thereby separating said one of said tissues from said succeeding tissues.

2. A tissue package according to claim 1 wherein said engaging tab is cantilevered from said dispensing package.

3. A tissue package according to claim 1, wherein said engaging tab is joined to one of said inner surfaces at a proximal end and extends through said dispensing opening to terminate at a distal end.

4. A tissue package according to claim 1 wherein said engaging tab intercepts said tissues and causes separation of adjacent tissues by creating friction between said one tissue and said succeeding tissues.

5. A tissue package according to claim 4 wherein said tissues are interleaved.

6. A tissue package according to claim 2 wherein each said tissue is separable from an adjacent tissue at a line of weakness.

7. A tissue package according to claim 6 wherein said engaging tab intercepts said line of weakness between adjacent tissues and causes separation of said tissues at said line of weakness.

8. A tissue package according to claim 7 wherein said line of weakness comprises an elongate slit between adjacent tissues.

9. A tissue package according to claim 8 wherein said elongate slit is complementary to said engaging tab, such that as said tissue is dispensed through said dispensing opening, said engaging tab intercepts said elongate slit to cause tearing at said line of weakness.

10. A tissue package comprising tissues and a dispensing package therefor in combination, said tissue package comprising:

a plurality of separable tissues, said tissues being separably joined together in succession for dispensing from said dispensing package; and a dispensing package for housing said tissues, said dispensing package having a dispensing opening therethrough, said tissues being dispensable through said dispensing opening, said dispensing package having an engaging tab joined thereto, wherein said engaging tab is biased towards said tissues, said engaging tab extending from a proximal end to a distal end, said tissues being interceptable by said tab as said tissues are dispensed from said dispensing package, thereby separating said one of said tissues from said succeeding tissues.

11. A tissue package according to claim 10 wherein said engaging tab is biased from a neutral position by the action of the dispensing of said tissues through said dispensing opening.

12. A tissue package comprising a dispensing package of tissues, said tissues being separably joined together in succession, each said tissue being separable from an adjacent tissue at a line of weakness, said dispensing package having a dispensing opening for dispensing said tissues therethrough, and an engaging tab, said engaging tab extending from a proximal end to a distal end and being joined to said dispensing package, said engaging tab being complementary to said lines of weakness, whereby said engaging tab intercepts said lines of weakness as said tissues are dispensed through said dispensing opening, said engaging tab being biased from a neutral position as it intercepts a said line of weakness, and thereby causing separation of one said tissue from succeeding tissues at said line of weakness.

13. A tissue package according to claim 12 wherein said engaging tab is integral with said dispensing package.

14. A tissue package according to claim 13 wherein said engaging tab is formed from a cutout of said rigid wall, wherein said cutout is folded away from said rigid wall.

15. A tissue package according to claim 14 wherein said line of weakness is generally transverse the principal direction of dispensing of said tissues and said line of weakness comprises an elongate slit, complementary to said engaging tab.

16. A tissue package comprising a dispensing package of tissues, said dispensing package comprising one or more rigid walls, said tissues being separably joined together in succession, each said tissue being separable from an adjacent tissue at a line of weakness, said dispensing package having a dispensing opening for dispensing said tissues therethrough, and an engaging tab, said engaging tab being formed from one of said rigid walls said engaging tab extending from a proximal end to a distal end and being joined to said dispensing package, said engaging tab being complementary to said lines of weakness, whereby said engaging tab intercepts said lines of weakness as said tissues are dispensed through said dispensing opening, and thereby causing separation of one said tissue from succeeding tissues at said line of weakness.

17. A tissue package comprising a dispensing package of tissues, said tissues being separably joined together in succession for dispensing from said dispensing package, said dispensing package having a dispensing opening for successively dispensing said tissues therethrough in response to a dispensing force, said dispensing force being sufficient to withdraw said tissues through said dispensing opening, said tissue package further comprising an engaging tab joined thereto, said engaging tab extending from a proximal end to a distal end, said engaging tab intercepting one of said tissues as it is dispensed from said dispensing package whereby said dispensing force undergoes a step increase when said engaging tab intercepts said tissue being dispensed, and thereby provides a tactile signal to a user that said engaging tab has intercepted said tissue.

* * * * *